US009022629B2

(12) United States Patent
Chen

(10) Patent No.: US 9,022,629 B2
(45) Date of Patent: May 5, 2015

(54) LIGHT EMITTING DIODE AUTOMOBILE LAMP

(71) Applicant: Hon Hai Precision Industry Co., Ltd., New Taipei (TW)

(72) Inventor: Po-Chou Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 111 days.

(21) Appl. No.: 13/945,884

(22) Filed: Jul. 18, 2013

(65) Prior Publication Data

US 2014/0185308 A1 Jul. 3, 2014

(30) Foreign Application Priority Data

Dec. 27, 2012 (TW) ..... 101150702 A

(51) Int. Cl.
*F21V 7/04* (2006.01)
*F21S 8/10* (2006.01)

(52) U.S. Cl.
CPC ..... *F21S 48/1241* (2013.01); *F21S 48/1159* (2013.01); *F21S 48/1225* (2013.01); *F21S 48/1329* (2013.01)

(58) Field of Classification Search
USPC ..... 362/612, 613, 545, 487
See application file for complete search history.

(56) References Cited

U.S. PATENT DOCUMENTS

2004/0008516 A1* 1/2004 Amano ..... 362/300
2014/0321137 A1* 10/2014 Chen ..... 362/511

* cited by examiner

*Primary Examiner* — Evan Dzierzynski
(74) *Attorney, Agent, or Firm* — Novak Druce Connolly Bove + Quigg LLP

(57) ABSTRACT

An LED automobile lamp includes a light source, a light guiding plate and a lens. The light guiding plate is adjacent to the light source. The lens is spaced from the light source and the light guiding plate. The light guiding plate includes a top surface which includes a horizontal section and an inclined section extending upward from one end of the horizontal section. Light generated by the light source enters the light guiding plate and is regulated to a preset luminance shape with cut-off lines at a top thereof by the horizontal section and the inclined section of the top surface of the light guiding plate. Light from the light guiding plate radiates out via the lens. A prism plate assembly is located between the lens and the light guiding plate for aligning the light from the light guiding plate to the lens.

12 Claims, 3 Drawing Sheets

LIGHT EMITTING DIODE AUTOMOBILE LAMP

BACKGROUND

1. Technical Field

The present disclosure generally relates to semiconductor lamps, and particularly to a light emitting diode (LED) automobile lamp.

2. Description of the Related Art

LEDs have many advantages, such as high luminosity, low operational voltage, low power consumption, compatibility with integrated circuits, faster switching, long term reliability, and environmental friendliness which have promoted their wide use as a light source.

A conventional LED automobile lamp includes an LED light source, a reflecting shell, a shading plate and a lens. Light generated by the LED light source is regulated by the shading plate to obtain a light source with a plurality of cut-off lines. Then the light source travels through the lens to illuminate. However, when the light pass through the traditional shading plate, a part of light is blocked by the shading plate from illumination. Accordingly, the light output of the LED light source of the LED automobile lamp is not fully utilized and a light outputting efficiency of the LED automobile lamp is low.

Therefore, it is desirable to provide an LED automobile lamp which can overcome the above-described problems.

BRIEF DESCRIPTION OF THE DRAWINGS

Many aspects of the disclosure can be better understood with reference to the drawings. The components in the drawings are not necessarily drawn to scale, the emphasis instead being placed upon clearly illustrating the principles of the present LED automobile lamp. Moreover, in the drawings, all the views are schematic, and like reference numerals designate corresponding parts throughout the views.

DETAILED DESCRIPTION

Figure 1:
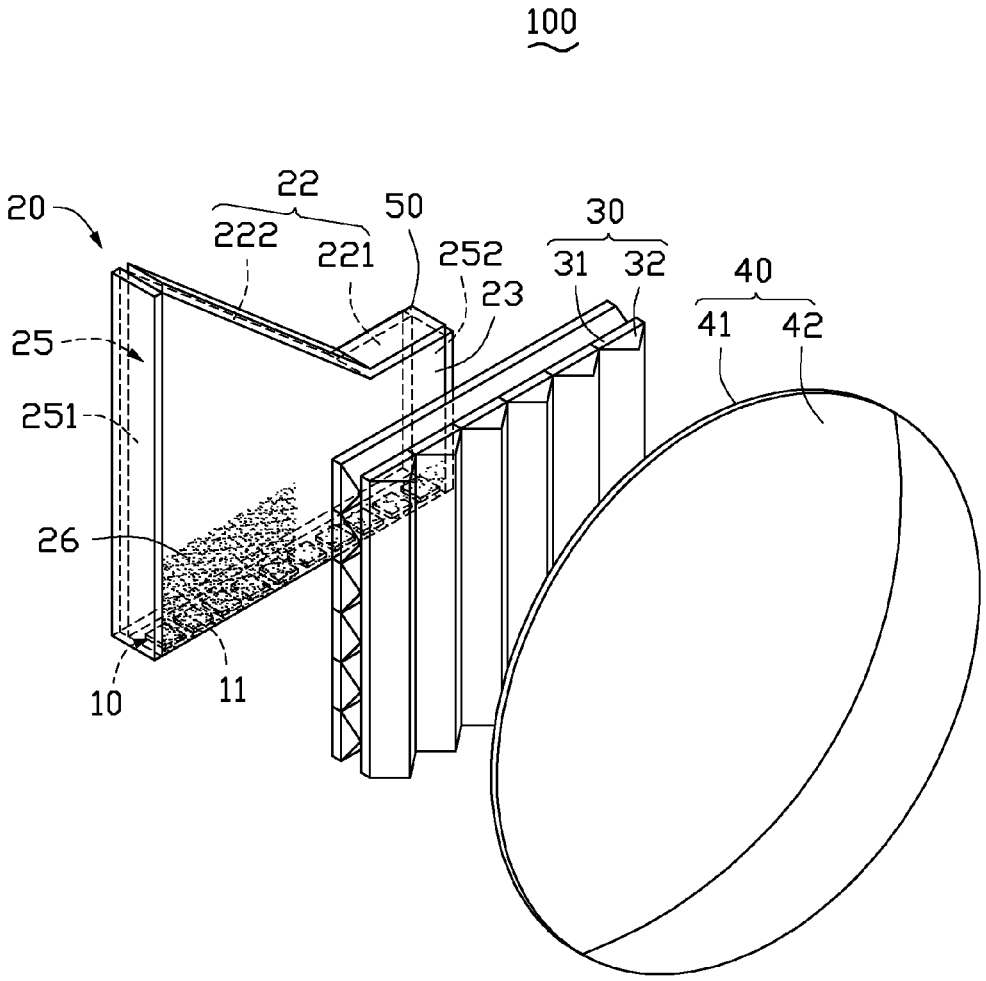
FIG. 1 is an isometric, exploded view of an LED automobile lamp in accordance with an exemplary embodiment of the present disclosure.
Figure 2:
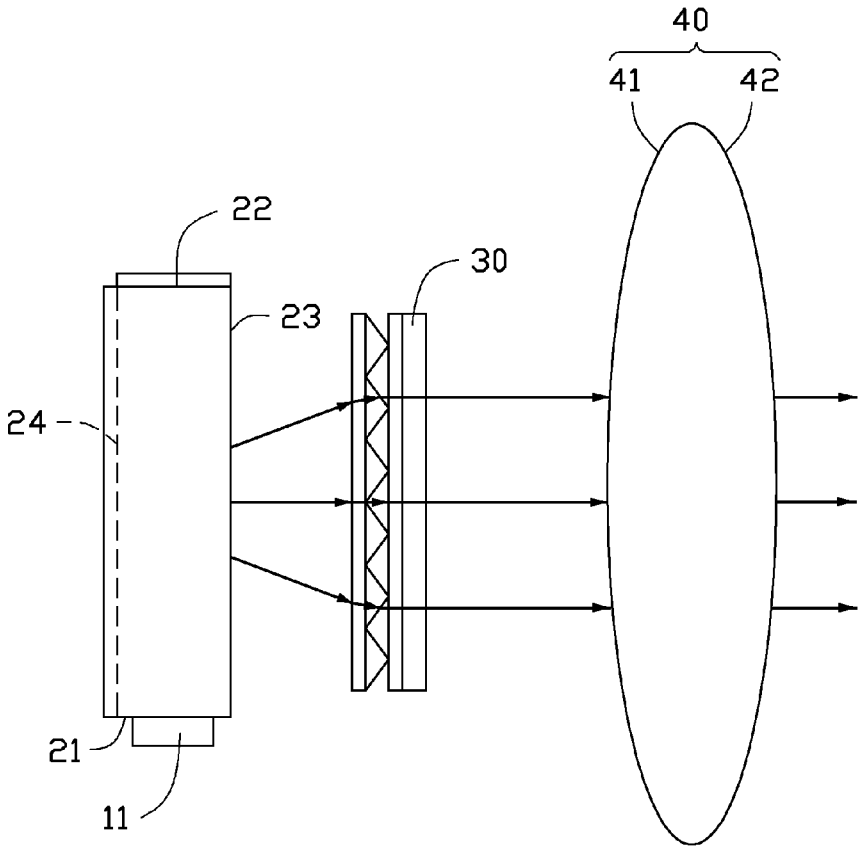
FIG. 2 is a side view of the LED automobile lamp of FIG. 1.
Figure 3:
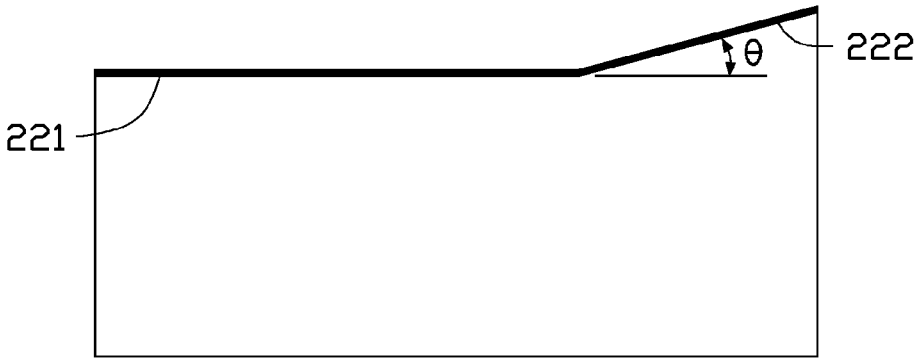
FIG. 3 is a schematic view of a luminance shape with cut-off lines of the light radiating out of the LED automobile lamp of FIG. 1.

Referring to FIGS. 1 to 3, an LED automobile lamp 100 in accordance with an exemplary embodiment is provided. The automobile lamp 100 includes a light source 10, a light guiding plate 20, a prism plate assembly 30 and a lens 40. The light guiding plate 20, the prism plate assembly 30, and the lens 40 are spaced from each other and are aligned with each other. The light guiding plate 20 is arranged above the light source 10. The prism plate assembly 30 is arranged between the light guiding plate 20 and the lens 40.

The light source 10 includes a plurality of LED packages 11. The LED packages 11 are mounted on a circuit print board (PCB) (not shown) and electrically connecting with circuits arranged thereon.

The light guiding plate 20 is transparent. The light guiding plate 20 includes an incident surface 21, a top surface 22 opposite to the incident surface 21, a light outputting surface 231, a back surface 24 opposite to the light outputting surface 23, and two side surfaces 25. The light outputting surface 23 and the back surface 24 respectively connect opposite sides of the incident surface 21 and the top surface 22. The side surfaces 25 respectively connect opposite ends of the incident surface 21 and the top surface 22.

Referring to FIG. 3, the incident surface 21 is arranged above the LED packages 11 and covers the LED packages 11. A shape of the top surface 22 is the same as the cut-off line which complies with relevant law and regulations. The top surface 22 includes a horizontal section 221 and an inclined section 222 extending upward and leftward from one end of the horizontal section 221. In this embodiment, an angle θ between the inclined section 222 and an extension line of the horizontal section 221 is 15 degrees.

A plurality of nodes 26 is arranged at a lower portion of the light outputting surface 23. The nodes 26 are microstructures for avoiding the light from being totally reflected in the light guiding plate 20. Specifically, the number of the nodes 26 corresponding to an area of the light outputting surface 23 bearing a high-profiled light output of the light guiding plate 20 (i.e., a left part of the light guiding plate 20) is more than that of the nodes 26 corresponding to an area of the light outputting surface 23 bearing a low-profiled light output of the light guiding plate 20 (i.e., a right part of the light guiding plate 20). The nodes 26 corresponding to the high-profiled light output area are densely arranged on the light outputting surface 23, and the nodes 26 corresponding to the low-profiled light output area are dispersedly arranged on the light outputting surface 23. Brightness of the light radiating out from the light outputting surface 23 is regulated by the nodes 26 to be more uniform.

A shape of the back surface 24 is the same to the light outputting surface 23. The back surface 24 is parallel to the light outputting surface 23. The two side surfaces 25 extend upward from the incident surface 21 to the top surface 22, and to connect the light outputting surface 23 and the back surface 24. The two side surfaces include a first side surface 251 and a second side surface 252 opposite to the first side surface 251. Specifically, the first side surface 251 interconnects one end of the inclined section 222 away from the horizontal section 221 and one end of the incident surface 21. The second side surface 252 interconnects one end of the horizontal section 221 away from the inclined section 222 and an opposite end of the incident surface 21. A height of the first side surface 251 is higher than a height of the second side surface 252. The first and second side surfaces 251, 252 are parallel to each other. The top surface 22, the back surface 24, the first side surface 251 and the second side surface 252 each are covered by a reflecting sheet 50. The reflecting sheets 50 reflect light from the incident surface 21 to radiate out via the light outputting surface 23.

When light generated by the light source 10 enters the light guiding plate 20 via the incident surface 21, a plurality of distinct cut-off lines are formed at the top surface 22 of the light guiding plate 20. Specifically, according to the relevant law and regulations, since a height of the horizontal section 221 is lower than 1.25 meters of another automobile (not shown), thus cut-off lines located at the horizontal section 221 avoids the light from directly striking eyes of a driver of the another automobile facing to the LED automobile lamp 100, and the driver of the another automobile will not be glared by the light from the LED automobile lamp 100. Simultaneously, the light located at the inclined section 222 illuminates a road condition of an end away from the another automobile. In this embodiment, for complying with relevant law and regulations of the United States, the horizontal section 221 is arranged at a left end of a forward driving direction of the automobile, and the inclined section is arranged at a right end of the horizontal section 221. Alternatively, a relative position of the horizontal section and the inclined section can be exchanged according to a corresponding law and regulations of a left hand traffic of a different country, for example, United Kingdom.

The prism plate assembly 30 is arranged between the light guiding plate 20 and the lens 40. The light from the light outputting surface 23 is converged by the prism plate assembly 30 to be aligned with the lens 40 and thereby radiates to the lens 40. In this embodiment, the prism plate assembly 30 includes two prism plates. Each prism plate includes a main body 31 and a plurality of prisms 32 formed on the main body 32. The main body 31 is a plane. The prism 32 is a triangular prism. The prisms 32 are parallel with each other. Opposites sides of one of the prisms 32 respectively connect sides of two adjacent prisms 32. The two prism plates are stacked together along front-to-reader direction and the prisms 32 of the two prism plates 30 are perpendicular to each other. The light from the light guiding plate 20 is converged firstly vertically by the rear prism plate and then horizontally by the front prism plate to project onto the lens 40.

The lens 40 is a convex lens. The lens 40 includes a first surface 41 and a second surface 42 opposite to the first surface 41. The first surface 41 is convex and the second surface 42 is also convex. The light from the prism 30 enters the lens 40 via the first surface 41 and radiates to ambient environment via the second surface 42. The lens 40 can be a spherical lens or an aspheric lens.

When the LED automobile lamp 100 works, light generated by the LED packages 11 enters the light guiding plate 20 via the incident surface 21. The light is reflected by the reflecting sheets 50 to illuminate via the light outputting surface 23. Since the shape of the top surface 22 is the same as that of the cut-off line of relevant law and regulations, the light radiating out from the light guiding plate 20 is regulated to a preset luminance shape meeting the relevant law and regulations. The light with the preset luminance shape is converged by the prism 30 to have a proper size without changing the luminance shape of the light to be aligned with the lens 40. Finally, the light radiates to ambient environment via the lens 40.

Since the light guiding plate 20 with high light outputting efficiency is used in the LED automobile 100 instead of the traditional shading plate and no light from the light source 10 is blocked, a utilization of the light from the light source 10 is high and accordingly an efficiency of the LED automobile lamp 10 is improved.

It is to be understood that the above-described embodiments are intended to illustrate rather than limit the disclosure. Variations may be made to the embodiments without departing from the spirit of the disclosure. The above-described embodiments illustrate the scope of the disclosure but do not restrict the scope of the disclosure.

What is claimed is:

1. A light emitting diode (LED) automobile lamp comprising:

a light source;

a light guiding plate adjacent to the light source, the light guiding plate comprising a top surface, the top surface comprising a horizontal section and an inclined section extending upward from one end of the horizontal section, light generated by the light source entering the light guiding plate and being regulated to a preset luminance shape with cut-off lines at a top thereof by the horizontal section and the inclined section of the top surface of the light guiding plate; and a lens spaced from the light source and the light guiding plate, light from the light guiding plate radiating out via the lens.

2. The LED automobile lamp of claim 1, wherein the light guiding plate is an edge-type light guiding plate, the light guiding plate comprising a light outputting surface, the light outputting surface being adjacent to the top surface.

3. The LED automobile lamp of claim 2, wherein a plurality of nodes are formed on the light outputting surface, brightness of the light radiating out from the light outputting surface being regulated by the nodes.

4. The LED automobile lamp of claim 3, wherein the number of the nodes corresponding to an area of the light guiding plate with a high-profiled light output is more than that of the nodes corresponding to an area with a low-profiled light output, and a density of the nodes corresponding to the area with a high-profiled light output is greater than that of the nodes corresponding to the area with a low-profiled light output.

5. The LED automobile lamp of claim 3, wherein the light source comprises a plurality of LED packages, the light guiding plate further comprising an incident surface, the incident surface being arranged above the light source and covering the LED packages, the incident surface being opposite to the top surface and adjacent to the light outputting surface.

6. The LED automobile lamp of claim 5, wherein the light guiding plate further comprises a back surface opposite to the light outputting surface, and two side surfaces between the incident surface and the top surface, the top surface, the back surface and the two side surface each being covered by a reflecting sheet.

7. The LED automobile lamp of claim 1, wherein an angle between an extension of the horizontal section and the inclined section is 15 degrees.

8. The LED automobile lamp of claim 1 further comprising a prism plate assembly, the prism plate assembly being arranged between the light outputting surface and the lens.

9. The LED automobile lamp of claim 8, wherein the prism plate assembly includes two prism plates, each prism plate comprising a main body and a plurality of prisms formed on the main body, each prism being a triangular prism, the two prism plates being stacked together along a direction from the lens to the light guiding plate and the prisms of the two prism plates being arranged perpendicular to each other.

10. The LED automobile lamp of claim 1, wherein the lens is convex, the lens comprising a first surface and a second surface opposite to the first surface, the first surface being convex and the second surface being also convex, light from the light guiding plate entering the lens via the first surface and radiating out via the second surface.

11. The LED automobile lamp of claim 1, wherein the horizontal section is arranged at a left end of a forward driving direction of an automobile having the LED automobile lamp, and the inclined section is arranged at a right end of the horizontal section.

12. The LED automobile lamp of claim 1, wherein the horizontal section is arranged at a right end of a forward driving direction of an automobile having the LED automobile lamp, and the inclined section is arranged at a left end of the horizontal section.

* * * * *